US008281732B1

(12) United States Patent
Irvine

(10) Patent No.: US 8,281,732 B1
(45) Date of Patent: Oct. 9, 2012

(54) BOAT CONVERSION TOWERS

(75) Inventor: Trey Irvine, Weston, FL (US)

(73) Assignee: Pipe Welders, Inc., Ft. Lauderdale, FL (US)

( * ) Notice: Subject to any disclaimer, the term of this patent is extended or adjusted under 35 U.S.C. 154(b) by 452 days.

(21) Appl. No.: 12/562,376

(22) Filed: Sep. 18, 2009

Related U.S. Application Data

(63) Continuation-in-part of application No. 11/741,967, filed on Apr. 30, 2007, now abandoned.

(51) Int. Cl.
*B63B 35/44* (2006.01)

(52) U.S. Cl. ..... 114/364; 114/343

(58) Field of Classification Search ..... D12/317; 114/357, 343, 364, 361, 255, 65 R, 85, 71; 182/115–126
See application file for complete search history.

(56) References Cited

U.S. PATENT DOCUMENTS

| | | | | |
|---|---|---|---|---|
| 3,174,166 | A * | 3/1965 | Ehrenberg et al. | 114/357 |
| 3,724,595 | A | 4/1973 | Green | |
| 4,729,334 | A | 3/1988 | DeJean, Jr. | |
| 4,947,780 | A * | 8/1990 | Finn | 114/263 |
| 5,297,844 | A | 3/1994 | Haustein | |
| 5,590,616 | A | 1/1997 | Vera | |
| 6,604,606 | B1 | 8/2003 | McDougal et al. | |
| 6,725,799 | B2 | 4/2004 | Tull | |
| 6,948,587 | B2 | 9/2005 | Griffiths | |
| 6,988,461 | B1 | 1/2006 | James | |

FOREIGN PATENT DOCUMENTS

| | | |
|---|---|---|
| GB | 2170854 | 8/1986 |

OTHER PUBLICATIONS

Chesapeake Bay article, Feb. 2000 article on the "Davis 50 Sportfisherman".

* cited by examiner

*Primary Examiner* — Edwin Swinehart
(74) *Attorney, Agent, or Firm* — Malin Haley DiMaggio Bowen & Lhota, P.A.

(57) ABSTRACT

A boat tower conversion kit for converting from a half tower to a full tower without the need for complete removal and/or destruction of the original half tower. A custom hard top incorporates a central core platform with several integral reinforcing plates. The plates provide structural support for the later expansion of the half tower by adding the upper tower section and upper platform(s). Leg members and ladder members of the upper and lower tower sections automatically mate with one-another in coaxial alignment, and are structurally secured to one-another through the interfacing integral reinforcing plates. Integral channels, wiring conduits and tubes provide for electrical wiring, electrical and mechanical components in conjunction with the custom platform core.

5 Claims, 16 Drawing Sheets

BOAT CONVERSION TOWERS

CROSS REFERENCE TO RELATED APPLICATIONS

This Continuation In Part application claims priority on and from U.S. Utility patent application Ser. No. 11/741,967, entitled Convertible Boat Tower filed on Apr. 30, 2007.

BACKGROUND OF THE INVENTION

1. Field of the Invention

The present invention relates generally to the boating industry towers for marine vessels, and more specifically to a novel, convertible boat tower which allows a boat owner to add an enhanced and elevated tower section to an existing half-tower.

2. Description of Related Art

The boating industry has several types of towers to be used on boats such as Tuna Towers, Marlin Towers®, half towers, bimini hard tops, and the like. Several towers are removable, and it is possible for a boat owner or user to reconfigure or change the shape and size of the tower on the boat. However, at present, this task is expensive and requires the user to completely remove the existing tower structure from the boat in order to add the new tower of a different design. This is time consuming, cumbersome, and expensive, as it requires the destruction of the old tower, complete design and manufacture of the new tower, as well as substantial fiberglass or structural work to the hull of boat. The old tower support pads and securing hardware must be removed, the fiberglass and gel coats repaired, and new support structure must be installed to secure and accommodate the new tower. The prior art only tangentially has addressed similar problems:

U.S. Pat. No. 6,988,461 issued to James on Jan. 24, 2006 entitled TELESCOPING BOAT TOWER APPARATUS teaches a telescoping boat tower attachable to the deck of a boat with the lower part attached to a boat deck and the upper part positioned above the console of a boat. The upper part is slidably movable vertically with respect to the lower frame assembly through the use of pressurized fluid pumps. The James patent is permanently mounted to the boat in its complete structure.

U.S. Pat. No. 6,725,799 issued to Tull on Apr. 27, 2004 entitled CUSTOMIZABLE BOAT T-TOP AND METHOD OF INSTALLATION teaches an adjustable structure that allows for the installation of a rigid T-top in a variety of configurations. Once the structure is installed, it is unalterable without the complete removal of the structure from the boat.

U.S. Pat. No. 5,590,616 issued to Vera on Jan. 7, 1997 entitled SURF BOAT teaches a watercraft with two or more pontoons and at least three columns and more than one deck. The SURF BOAT does not mount to the deck of a boat, but it sits directly in water and provides a surface on which another object may sit.

U.S. Pat. No. 3,724,595 issued to Green on Apr. 3, 1973 entitled TUNA TOWER teaches specifically a tuna tower composed of opposing ladder sub-assemblies fixed to the gunwalls of a boat. The tuna tower is prefabricated and adjustable to fit a variety of sizes of boats. The TUNA TOWER is one complete structure and may not be altered in size or use once installed.

U.S. Pat. No. 6,948,587 issued to Griffiths on Sep. 27, 2005 entitled PORTABLE ELEVATED PLATFORM teaches a cart that can be pulled by a car or all terrain vehicle. It is capable of being converted into a free-standing elevated platform, a supported elevated platform, and a transportable cart configuration. One of the legs of the cart may be used as a ladder. The cart is to be used on land and does not suggest use in conjunction with a boat.

U.S. Pat. No. 6,604,606 issued to McDougal et al. on Aug. 12, 2003 entitled PORTABLE UTILITY STAND teaches a portable utility stand that attaches removably to a small vehicle such as a golf cart. It has a lower portion that is permanently attached to the vehicle and an upper portion that is pivotally attached to the lower portion. The upper portion may be adjusted to the desired height and position. It is not suggested that the stand is designed to be used in conjunction with boats.

U.S. Pat. No. 5,297,844 issued to Haustein on Mar. 29, 1994 entitled REMOVABLE CAB AND STAND FOR ALL TERRAIN VEHICLES TEACHES a cab or stand that is attachable and removable from the front and rear racks of an all terrain vehicle. It is contemplated that this stand is used for observation or hunting. It is not suggested that the stand be used in conjunction with boats.

U.K. Patent Application GB 2,170,854 A filed by Goldsmith published on Aug. 13, 1986 entitled A PLATFORM INCORPORATING SECTIONAL SUPPORTS teaches a platform with a trapezoidal platform support on an upwardly tapering construction of sectional support members. The platform has parallel long front and short rear edges. The platform has one structure and is not intended for use on boats.

Accordingly, what is needed in the art is an improved tower structure for a boat that can be converted from an existing half tower into a full tower of varying designs, without completely removing or destroying the old tower structure from the boat. In the instant solution to this problem, provides a novel half tower being design specifically to provide for future additions of elevated tower sections, avoiding the waste of hardware and fiberglass components, and seamlessly integrating with the new tower sections.

It is, therefore, to the effective resolution of the aforementioned problems and shortcomings of the prior art that the present invention is directed. However, in view of the boat tower and stand designs in existence at the time the present invention was created, it was not obvious to those persons of ordinary skill in the pertinent art and marine industry as to how the identified needs could be fulfilled.

SUMMARY OF THE INVENTION

It is in response to the above stated desires in the boating industry that the present invention was contemplated. In the marine industry, half towers are mounted generally above the cockpit and helm deck areas of the boat, and include bimini hard tops. The hard tops can be fabricated using foam core fiberglass or fiberglass layers with aluminum reinforcements, and with internal wire or conduit runs. The hard top is supported by aluminum tubing or metal composites, including brushed or anodized finishes. The aluminum tubing can be rectangular or cylindrical in cross-section, and alternatively steel or other metal composites can be utilized. The fiberglass tops can include options, such as molded instrument boxes, overhead lockers, molded radar, satellite and/or antenna pods, as well as molded Navigation/Stern lights. The hard tops can be constructed in appropriate thickness and strength of materials as to constitute standing platforms for use as observation towers or fishing platforms, in addition to supporting radar, satellite, outrigger or other equipment.

Tuna Towers are full height and dual platform towers, with a gap of at least four (4) between the lower bimini or bridge roof platform, and the higher standing/navigation platform. These towers also include and elevated control console and operator area, which can in turn be protected by a third sunshade or roof platform, as hereinafter described. An assortment of aluminum or steel members, legs, arms, support frames, ladders, struts, flanges, pads and/or pods typically support the tower platform and provide other functional equipment as well.

However, heretofore, half towers, Marlin Towers®, and Tuna Towers have been separate, independent and dissimilar structures. The marine industry has overlooked the problems associated with removing and replacing an original half tower on a boat, with a full tower at a later date. This is often a necessity for a boat owner who, several years after the initial purchase, advances in his/her seamanship, fishing or boating expertise, or desires, and therefore wants to upgrade the vessel and purchase a full tower. Conventional practice is to remove and discard the original half tower, platform, aluminum tubes, support frames, legs and ladders, and then repair the boat hull and deck. Thereafter, preparations are made for retrofitting the new, full tower, which requires new fiberglass cut-outs in the boat hull and deck, drilling for new hardware, entirely new support pads, tower hardware, ladders, etc. The labor and cost of materials is clearly substantial, as is the waste in removing and discarding the old tower entirely, and repairing the vessel.

The present invention is essentially a conversion kit which allows a boat owner to retain and convert an existing half tower on a boat to a full tower without the need for removal and destruction of the original tower structure from the boat itself, and avoiding the expensive and time consuming requirements for repairing the hull, deck, and gunwales of the boat, as well as installing new support hardware.

The conversion kit is comprised of two separate structures. The first structure is the original specially designed half tower that can be mounted to the deck of a boat through ladders which also function as support members for the platform, and separate leg members providing additional support. The ladders are most likely mounted to the gunwales/gunnels at the aft section of the half tower, or to a section of deck in the cockpit area. The leg frames of the half tower are most likely mounted to the fore section vessel, to any appropriately reinforced section of the bow or cabin walls or upper deck. As in conventional practice, ladder or leg members can be singular, or alternatively can have a plurality of support members.

The half tower also has a platform structure that constitutes the hard top over the cockpit and helm area, and that mounts to the top of the ladders and the top of the leg members. The platform can be manufactured from laminated fiberglass layers, composites, or can comprise a one piece cored fiberglass top. In either case, a separate tubular or rectangular metal frame corresponding generally to the shape of the platform and inset from its periphery, provides the horizontal framework to support and secure the platform itself. The ladders and legs are secured to the horizontal framework in conventional means, including welding, using hardware, or bonding techniques. In alternative embodiments, the platform can include integral reinforcement members within the molded fiberglass top, such as metal plates or flanges, internal tubular or rectangular metal braces, or the like. The half tower legs or ladders are then secured directly to the hard top.

At the location where the ladders mount to the platform, there are cut-out sections in the platform which provide generally semi-circular insets or voids in the corner areas of the hard top to allow a person climbing the ladder to upper levels to pass through or around the platform unobstructed. The platforms can also contain further voids, windows or holes in other areas, such as its center, for mounting satellite or radar units, accessory electronics or hardware, or the like.

The half tower with hard top is a complete tower, which a boat owner could retain throughout the life of the vessel. If, however, a full tower or tower addition is desired, the second tower section is seamlessly and easily mounted to the original tower, such that the two separate sections become an integrated, structurally sound, full tower having multiple elevated platforms.

The second structure constitutes the upper tower section, resembling a Tuna Tower. The top tower is mounted to the platform of the half tower through complementary and axially aligned leg members and ladders. The ladders mounting to the top tower can be designed with a bottom half having steps and an upper half being open, which allows for a boater to step through support members to the upper platform or deck. The ladders and leg frames have mounting pads or flanges welded to their bottom ends. The mounting pads are used to mount the ladders and leg frame members to the platform of the half tower. As mentioned above, the platform has been reinforced using one of alternative methods in the areas which secure and support the second tower section.

The top tower section further comprises an additional platform, which is supported by an additional generally horizontal framework located around the periphery of the second platform. As with the half tower platform, the additional platform could also incorporate internal reinforcing members, plates or flanges. The upper tower platform is secured to its ladder and frame members in similar fashion.

To provide stability to the vessel and further maintain a center of gravity for the boat hull, the legs and ladders of the platforms generally converge in vertical orientation from the lower boat deck to the uppermost tower section, and therefore platform of the top tower has a smaller surface area than the platform of the half tower. The platform of the top tower can also be equipped with wire distribution channels which allow electrical wires or cables to be laid in various locations on the platform to provide a variety of functions. These include steering gear, hydraulic, pneumatic or electrical power, voltage for navigation or cockpit lighting, gauges, or the like. As a design option, the top tower can be further equipped with an auxiliary seat and drive control console. Thus, a user may operate the boat from the top of the top tower if desired.

The towers are most likely mounted to the boat at a position over the helm or cockpit console area. Thus, wiring from the console is extended through wiring distribution devices on the half and top towers, and upwards through integral channels to appropriate communication or navigational devices.

In accordance with these and other objects which will become apparent hereinafter, the instant invention will now be described with particular reference to the accompanying drawings.

DETAILED DESCRIPTION

Figure 1A:
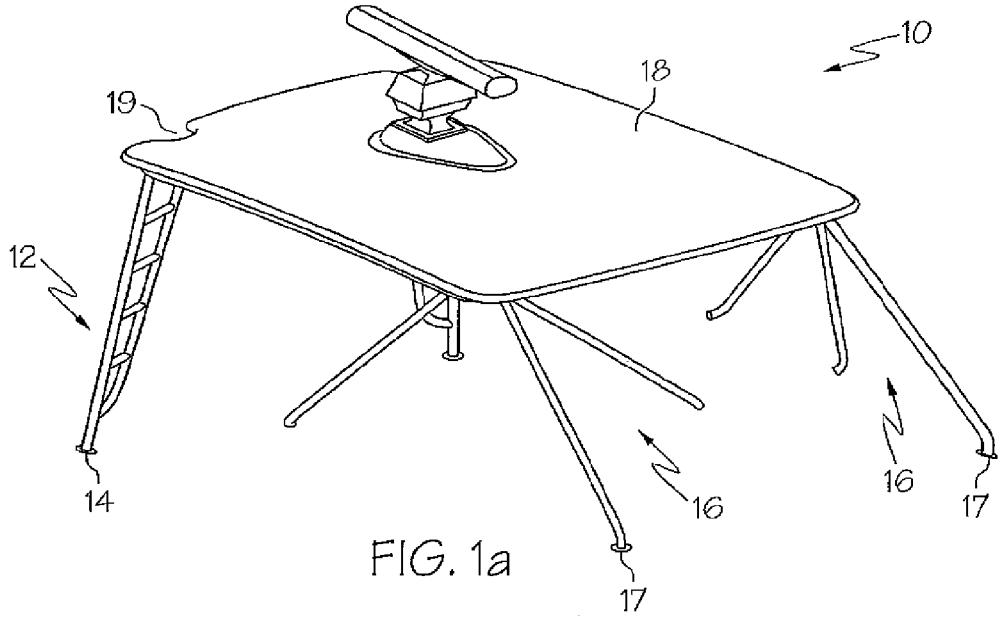
FIG. 1*a* illustrates a front perspective view of the lower half tower of the instant invention.

FIG. 1*a* shows a front perspective view of the lower half tower 10 as it would appear on a boat. The bottom tower structure 10 is directly mounted onto deck section and gunwales of a boat. In most desired configurations, the tower platform would cover the helm, control console, and portion of the cockpit area of the vessel. As shown, the bottom tower structure 10 is comprised of a pair of support ladders 12 located at the aft section of the lower half tower 10. The ladders 12 are mounted to the boat in a conventional manner, using appropriate pads, flanged ends, or mounting plates 14. The fore or bow side of the half tower 10 comprises a plurality of leg members 16, also having flanged ends or mounting plates 17. As shown in one embodiment, there are a pair of fore leg members 16, each having three (3) discrete leg elements. It is contemplated, however, that a greater or lesser number of leg elements could be utilized, depending on design choices and vessel configurations, as the instant invention is applicable of a variety of boat and yachts. These include, for example, express cruisers, sport yachts, fly bridge, sedan cruisers and the like. The precise number of leg elements utilized depends on shape and configuration of the boat hull, cockpit and helm area, cabin roof and decks. It is contemplated that each leg frame member 16 and the leg elements will be mounted to a different location on a boat, so as to provide further stability for the half tower 10. As shown, a first half tower platform 18 is securely mounted to, and supported by, the ladders 12 and leg members 16 at opposite ends from the mounting plates 14, 17. As discussed above, the hard top platform 18 can incorporate a one piece fiberglass core, or two piece fiberglass layers over rectangular or tubular aluminum members. The platform 18 is structurally sound so as to support boat occupants, communication, navigation and/or fishing equipment. As would be apparent to one of ordinary skill in the art, other rigid platform could be utilized in the instant invention.

In alternative embodiments, first elevated deck or platform 18 is supported by, and secured to, a generally horizontal metal framework, which constitutes a separate tubular or rectangular metal frame corresponding generally to the shape of the platform and inset from its periphery. The ladders and legs are secured to the horizontal framework in conventional means, including welding, using hardware, or bonding techniques. In alternative embodiments, the platform can include integral reinforcement members within the molded fiberglass top, such as metal plates or flanges, internal tubular or rectangular metal braces, or the like. The half tower legs or ladders are then secured directly to the hard top.

At the location where the ladders 12 mount to the first platform 18, there are cut-out sections 19 in the platform which can provide generally semi-circular insets or voids in the corner areas of the hard top to allow a person climbing the ladder to upper levels to pass through or around the platform unobstructed. The platforms can also contain further voids, windows or holes in other areas, such as its center, for mounting satellite or radar units, accessory electronics or hardware, or the like. The cut-outs 19 have a size and shape to allow a person to comfortably fit through. As shown, a variety of devices may be mounted onto the top of the first platform 18. For example, a radar antenna can be mounted onto the first platform 18. It is contemplated that the first platform 18 is equipped with recessed areas to receive fixtures for navigational lights, cockpit lights, or electronic devices along the edges of the platform, as well as internal channels for routing necessary electrical wiring, cabling, hydraulic or pneumatic lines, or similar hardware. Additionally, it is contemplated that the ladders 12 and the leg members 16 may be hollow and tubular, with internal channels, so as to allow for routing the necessary wiring or cables.

Figure 1B:
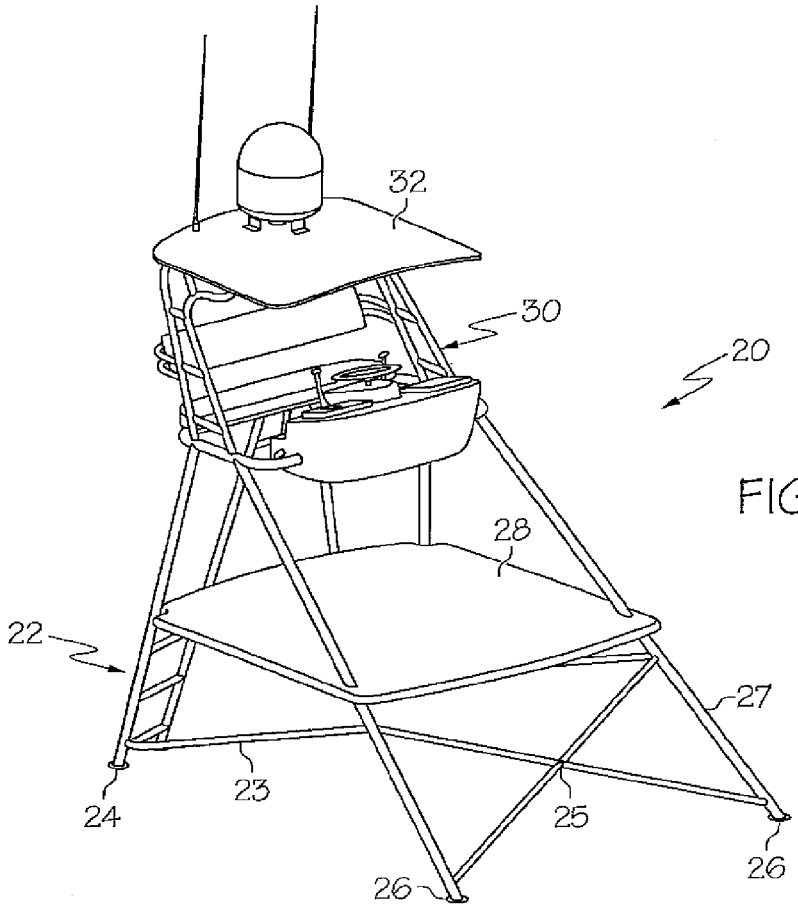
FIG. 1*b* illustrates a front perspective view of the upper tower section of the instant invention.

FIG. 1*b* illustrates a front perspective view of a top tower section 20 of the instant invention. The top tower structure 20 is specially designed with custom components and functional ability, such that the entire unit can be directly mounted onto the original half tower 10 of a vessel. It is to be appreciated that the original boat was either purchased with the half tower in original manufacturing as OEM equipment, or the half tower of the instant invention was added to the boat later. In either event, once the boat owner desires to upgrade the vessel and tower, and install a complete, full tower with multiple elevated platforms, the instant invention accomplishes that goal. Second upper tower section 20 fulfills this need, and "converts" the original half tower to a full Tuna Tower or alternative full tower design. This is accomplished by the complementary and interfacing design features of upper tower section 20, and the specially designed mating hardware components of the separate sections.

Upper tower section 20 is placed over and secured to first platform 18 of the bottom tower structure 10 utilizing ladders 22 and leg members 27. The ladders 22 and leg members 27 are mounted to the bottom tower structure 10 through the use of mounting pads 24 on the base of the ladders 22 and mounting pads 26 on the base of the leg members 27. The mounting pads 24, 26 allow the ladders 24 and leg members 27 to be quickly and easily mounted to the bottom tower structure 10. The mounting pads 24, 26 may have any shape necessary to maximize effectiveness, however a key aspect of this invention is that the mounting flanges, plates, pads and bolting hardware are precisely aligned and mated with corresponding structure of the lower half tower 10. Thus, the lower termination points of the ladders 22 and support legs 27 of upper tower section 20, are aligned with structurally reinforced areas of the lower tower platform 18, ladders 12 and support legs 16 of lower half tower 10. All ladders can be coaxially aligned, and certain leg elements can also be coaxially aligned. Ladders 22 are further aligned directly over the cut-outs 19 in the first platform 18 so to accomplish the above, and to allow a user to climb up the ladders 12 on the bottom tower structure 10, through the cut-outs 19, and continue climbing up the ladders 22 on the top tower structure 20. It is contemplated that additional bracing mechanisms 23, 25 may be utilized between the leg frames 27 and the ladders 22 to add structural rigidity to the upper tower structure 20. It is further contemplated that a second platform 28 will be mounted between the leg frames 27 and the ladders 22. As shown, the rungs of the ladders 22 on the upper tower structure 20 cease at the level where the second platform 28 is mounted. Thus, the user can climb up the ladders 22 and step onto the second support platform 28, which acts as an elevated hard top and floor or standing platform for the uppermost redundant drive station 30. It is further contemplated that a drive console 30 may be mounted near the top of the ladders 22 and the leg frames 27, and if desired additional aluminum or metal tubing can act as framework. The drive console 30 will further have a sun or equipment cover 32, to protect the user from the elements. The additional cover 32 can be a fabric bimini top, or alternative hard top, and either type can be reinforced to mount accessory equipment on the top thereof as shown in FIG. 1*b*.

Second platform 28 also may be equipped with recessed fixtures for LEDs along the edges as well as internal channels for routing the necessary electrical wiring. Additionally, it is contemplated that the ladders 22 and the leg frames 27 may be hollow and tubular so as to allow for routing the necessary electrical wiring or cables. Such electrical wiring, hydraulic or other cabling will extend to the drive station and console 30 to allow a captain to operate the boat and navigate from the uppermost elevated station. Optional conventional equipment includes seating, steering wheels, throttles and an instrument panel.

Figure 1C:
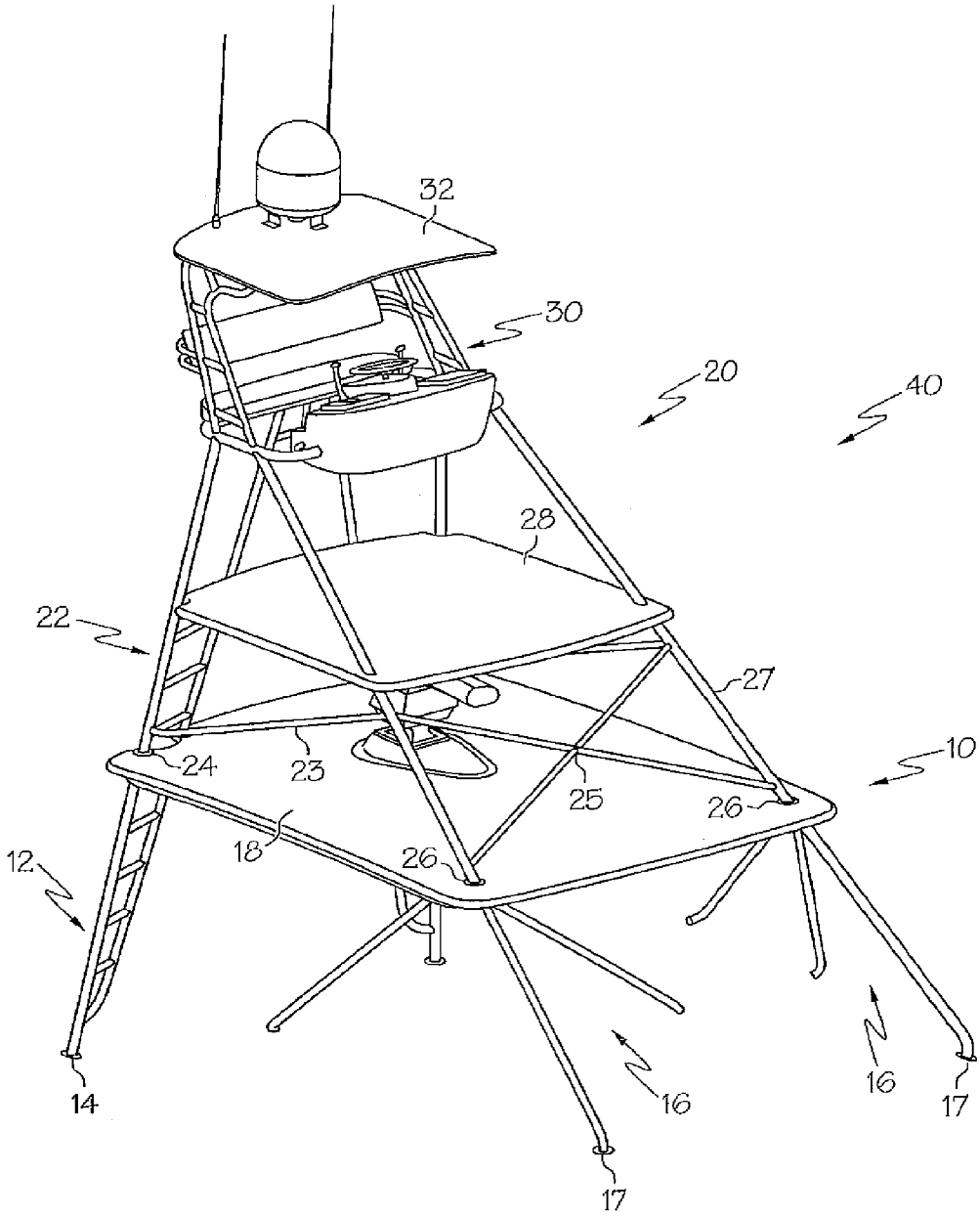
FIG. 1*c* depicts a front perspective view of the full tower conversion, with the top tower structure mounted onto the original half tower structure.

FIG. 1*c* depicts a front perspective view of the completed conversion to full tower 40, with the upper tower section 20 mounted onto lower half tower 10 through the use of mounting plates 26, 24. It will be appreciated that alternative mounting components and techniques can be utilized, including interlocking arms, recessed receivers, and welding.

Figure 2A:
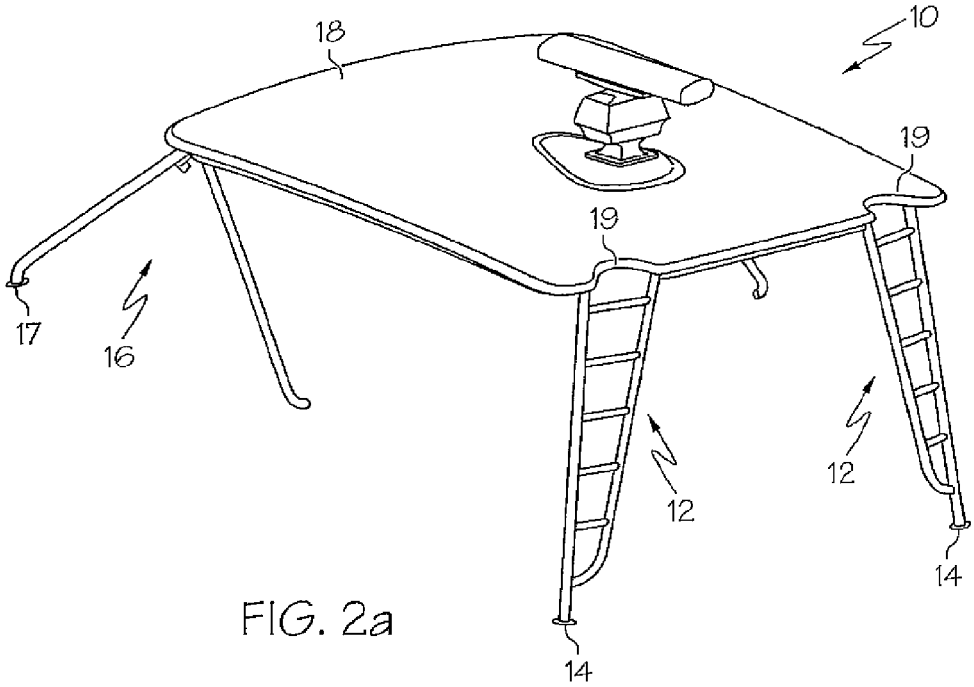
FIG. 2*a* shows a rear perspective view of the lower half tower of the instant invention.

FIG. 2*a* shows a rear perspective view of the bottom tower structure 10 as it would appear on a boat. FIG. 2*a* provides a further representation of the location and shape of the cut-outs 19 located on the first platform 18.

Figure 2B:
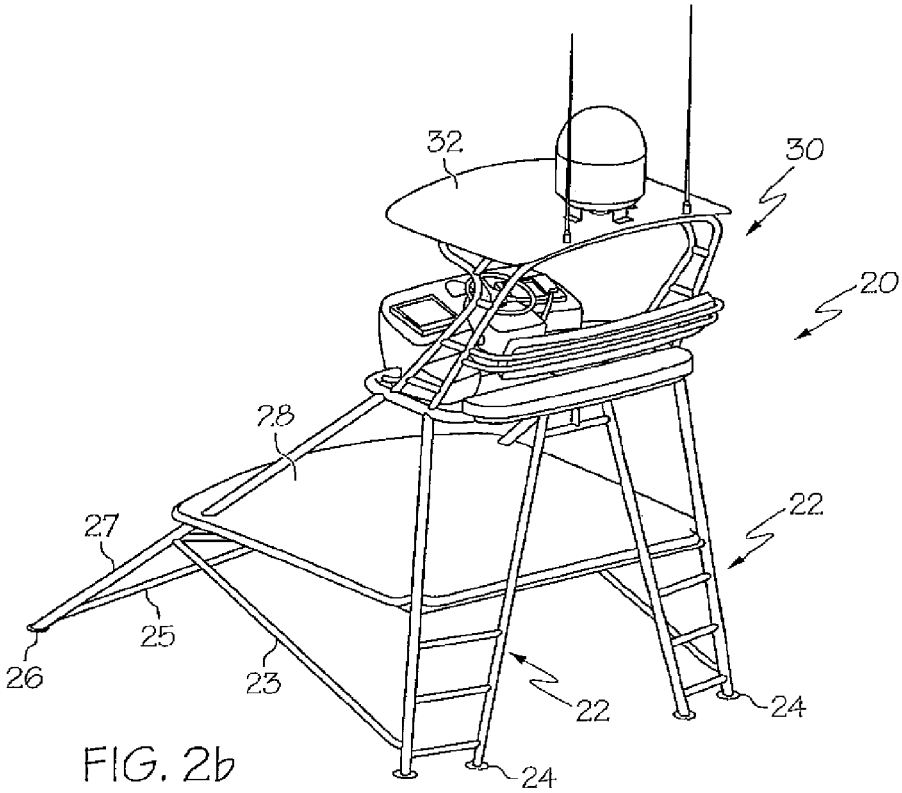
FIG. 2*b* illustrates a rear perspective view of the upper tower section of the instant invention.

FIG. 2*b* shows a rear perspective view of the top tower structure 20 as it would appear on a boat.

Figure 2C:
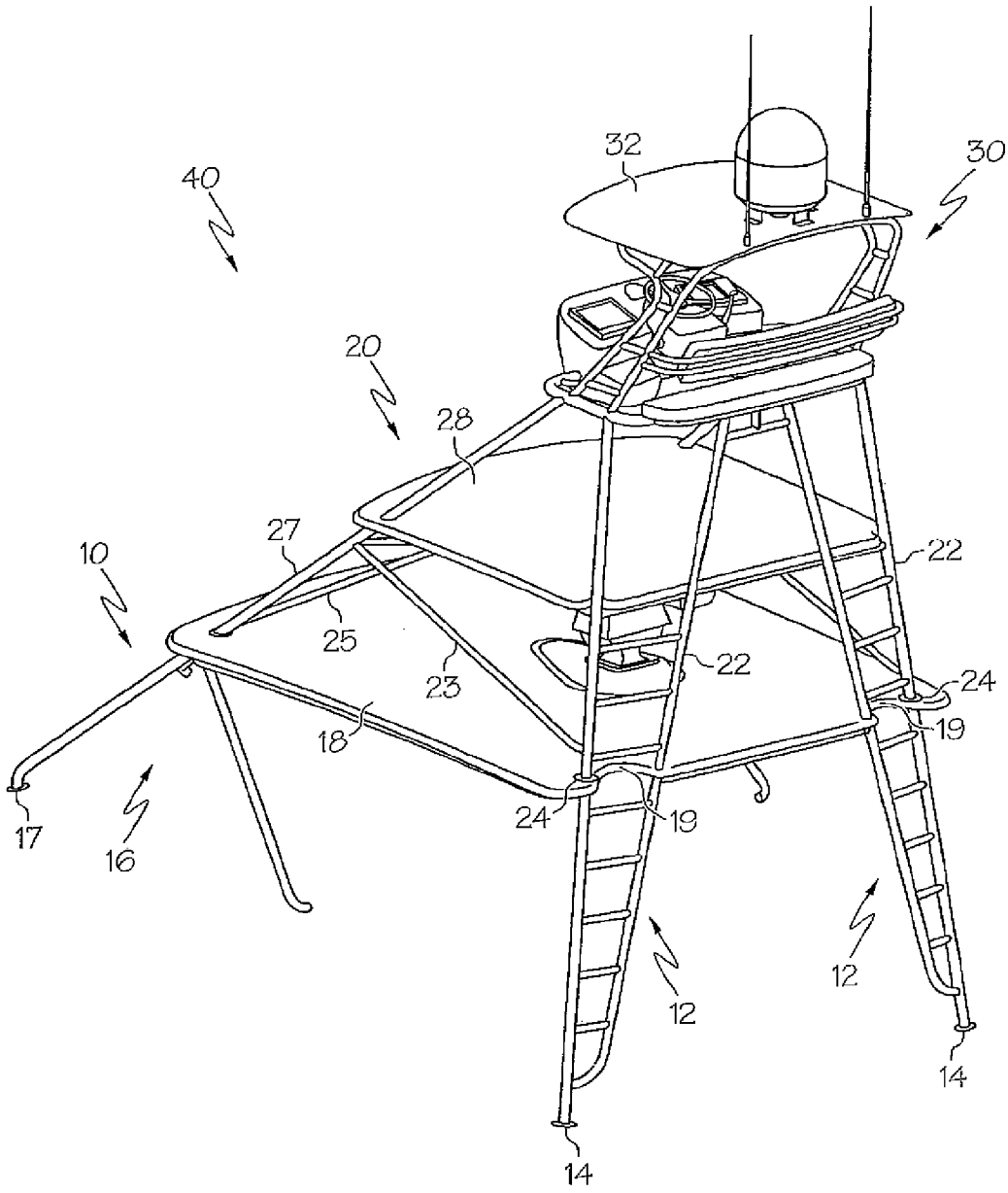
FIG. 2*c* illustrates a rear perspective view of the full tower conversion, with the top tower structure mounted onto the bottom tower structure.

FIG. 2*c* shows a rear perspective view of the complete conversion to full tower 40 with the top tower structure 20 mounted onto the bottom tower structure 10.

Figure 3A:
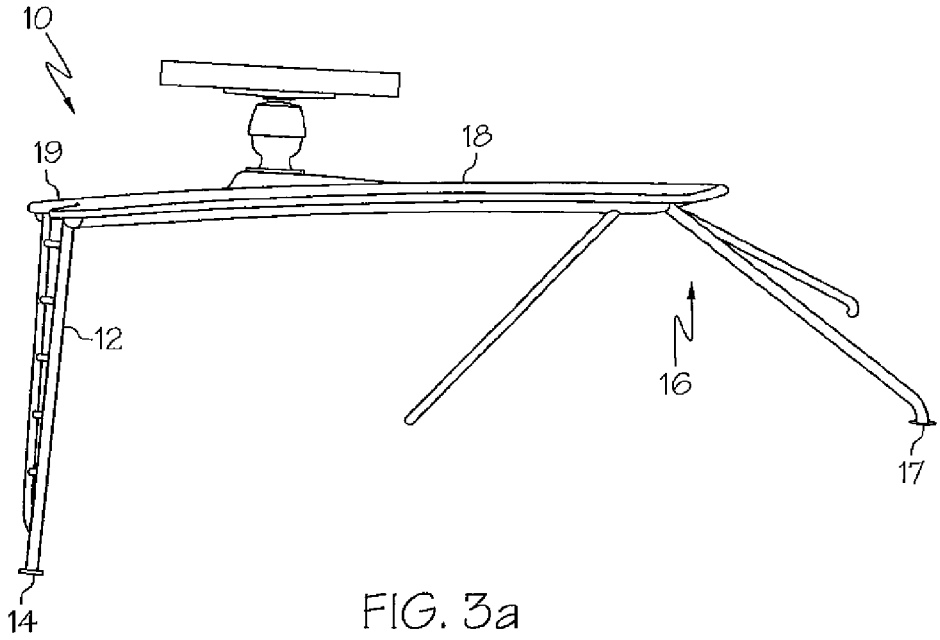
FIG. 3*a* shows a right side plan view of the half tower of the instant invention.

FIG. 3*a* illustrates a right side plan view of the bottom tower structure 10 as it would appear on a boat. FIG. 3*a* provides a further representation of the shape and length of the ladders 12 and leg members 16.

Figure 3B:
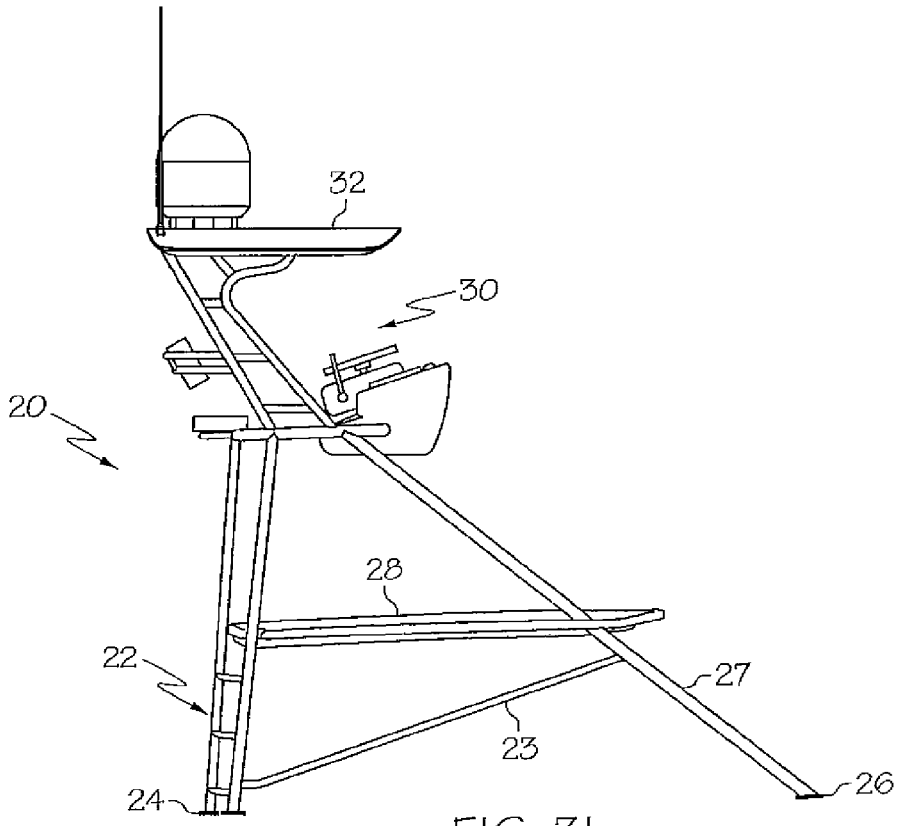
FIG. 3*b* shows a right side plan view of the upper tower section of the instant invention.

FIG. 3*b* shows a right side plan view of the top tower section 20 as it would appear on a boat.

Figure 3C:
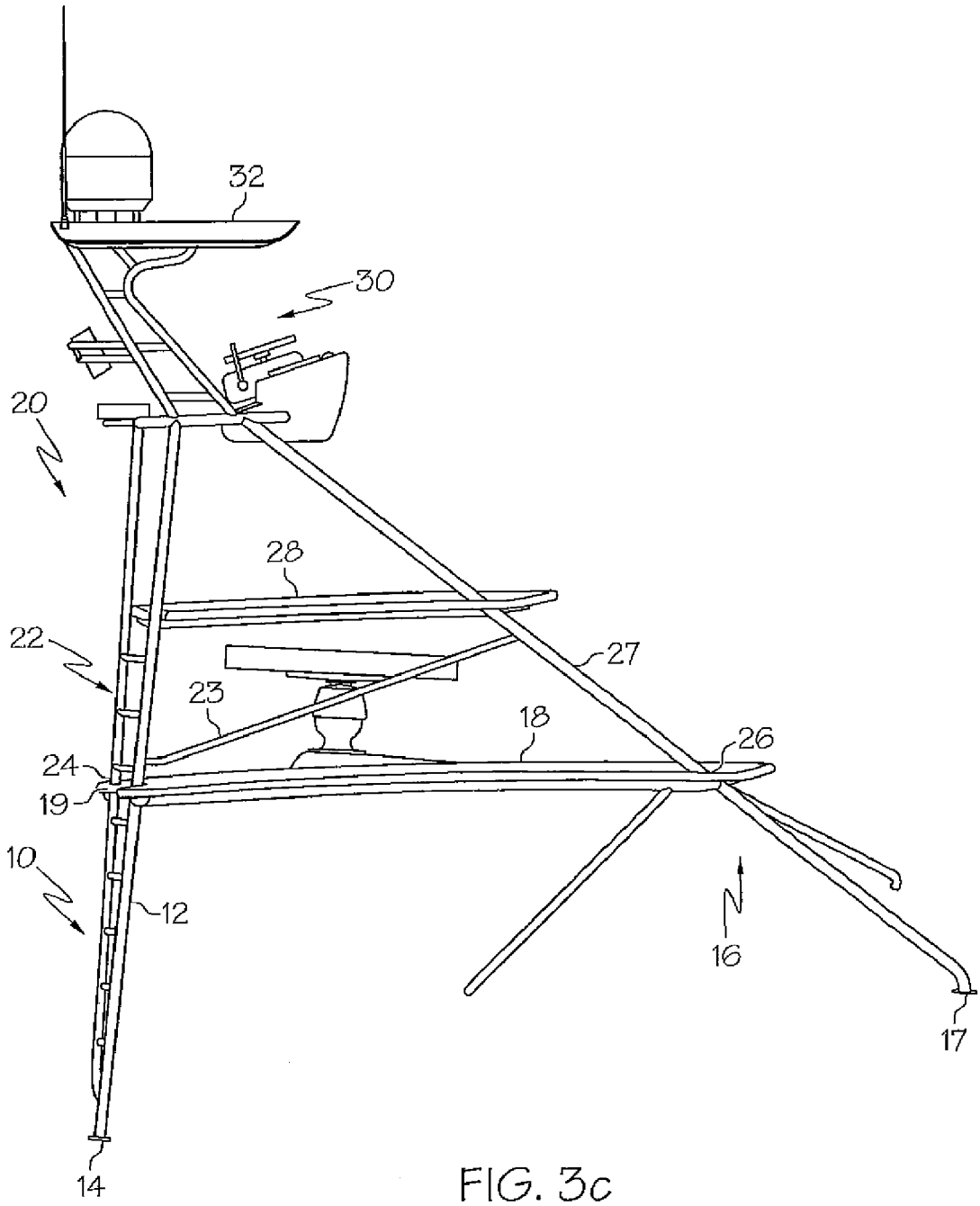
FIG. 3*c* shows a right side plan view of the full tower conversion, with the top tower structure mounted onto the bottom tower structure.

FIG. 3*c* shows a right side plan view of the completed conversion to full tower 40 with the top tower structure 20 mounted onto the bottom tower structure 10.

Figure 4A:
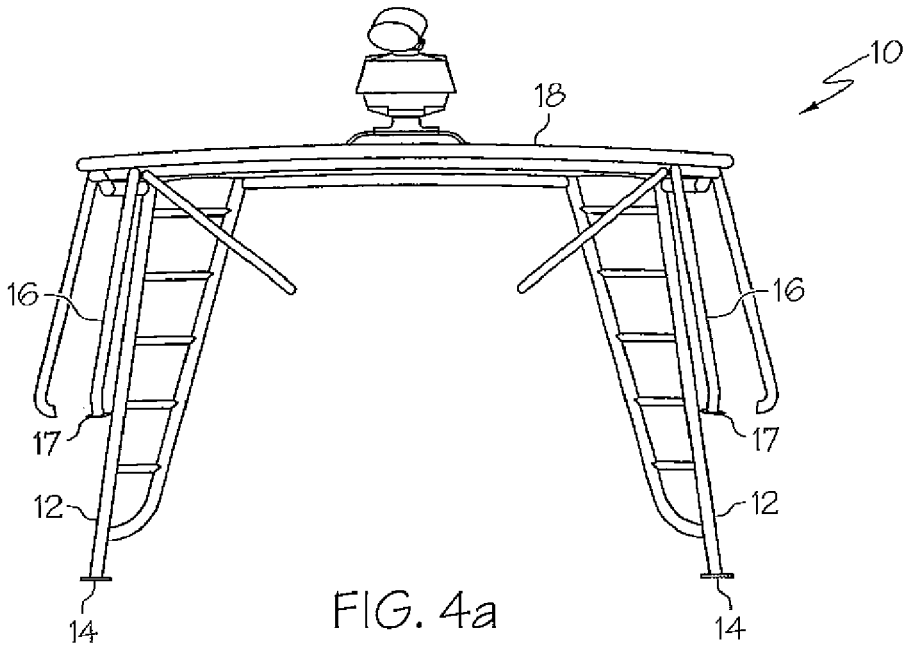
FIG. 4*a* shows a front plan view of the lower half tower structure of the instant invention.

FIG. 4*a* depicts a front plan view of the half tower 10 as it would appear on a boat.

Figure 4B:
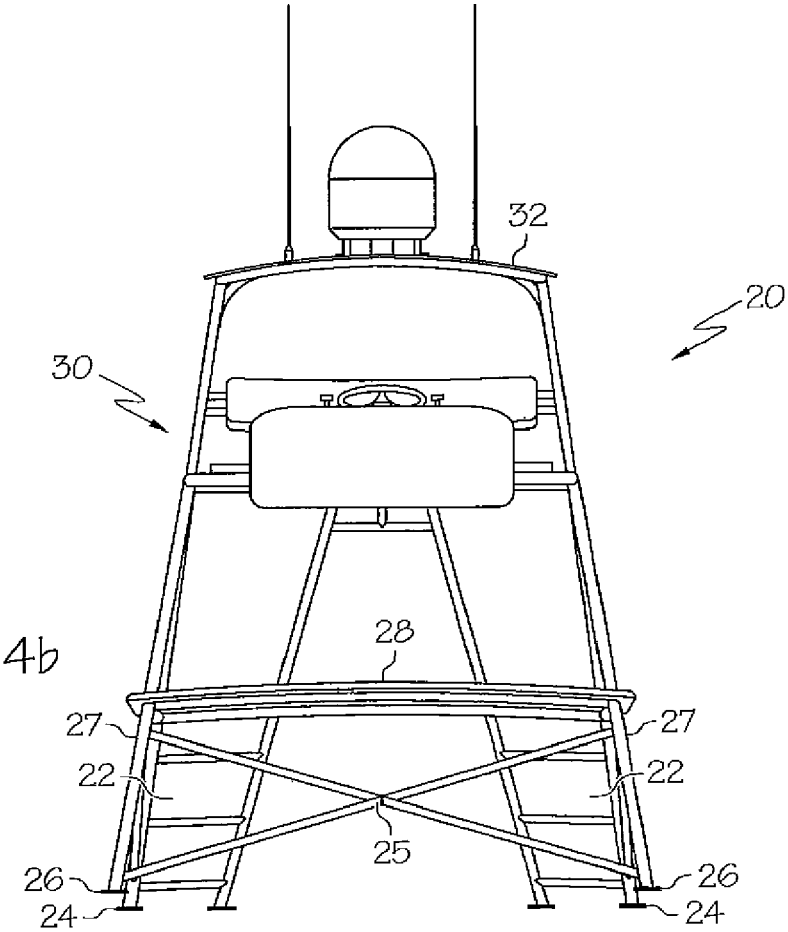
FIG. 4*b* shows a front plan view of the top tower section of the instant invention.

FIG. 4*b* shows a front plan view of the upper tower section 20 as it would appear on a boat.

Figure 4C:
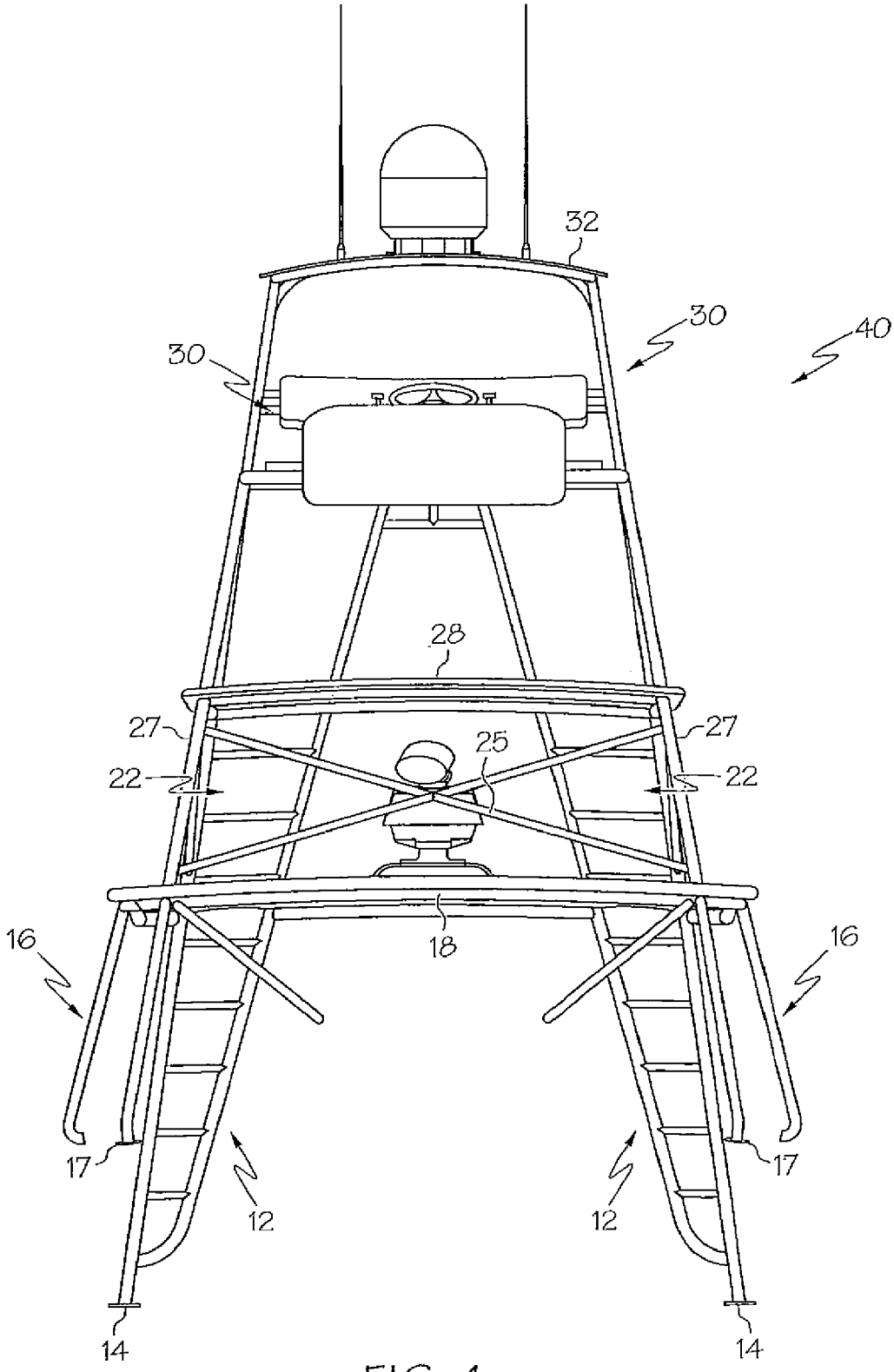
FIG. 4*c* shows a front plan view of the full tower conversion, with the top tower structure mounted onto the bottom tower structure.

FIG. 4*c* shows a front plan view of the completed conversion to full tower 40.

Figure 5:
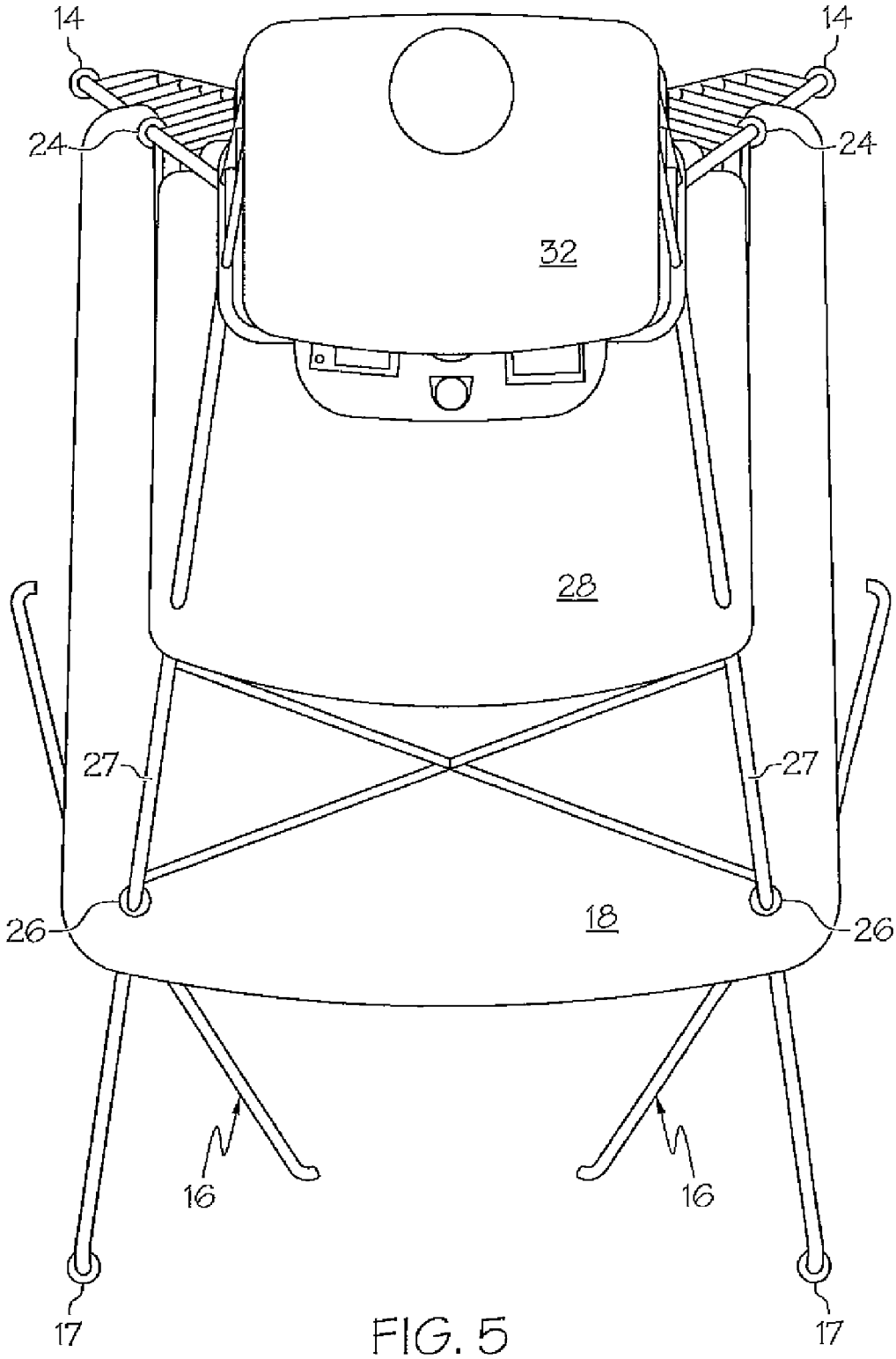
FIG. 5 shows a top plan view of the full tower conversion, with the top tower structure mounted onto the bottom tower structure.

FIG. 5 depicts a top plan view of full tower 40.

Figure 6:
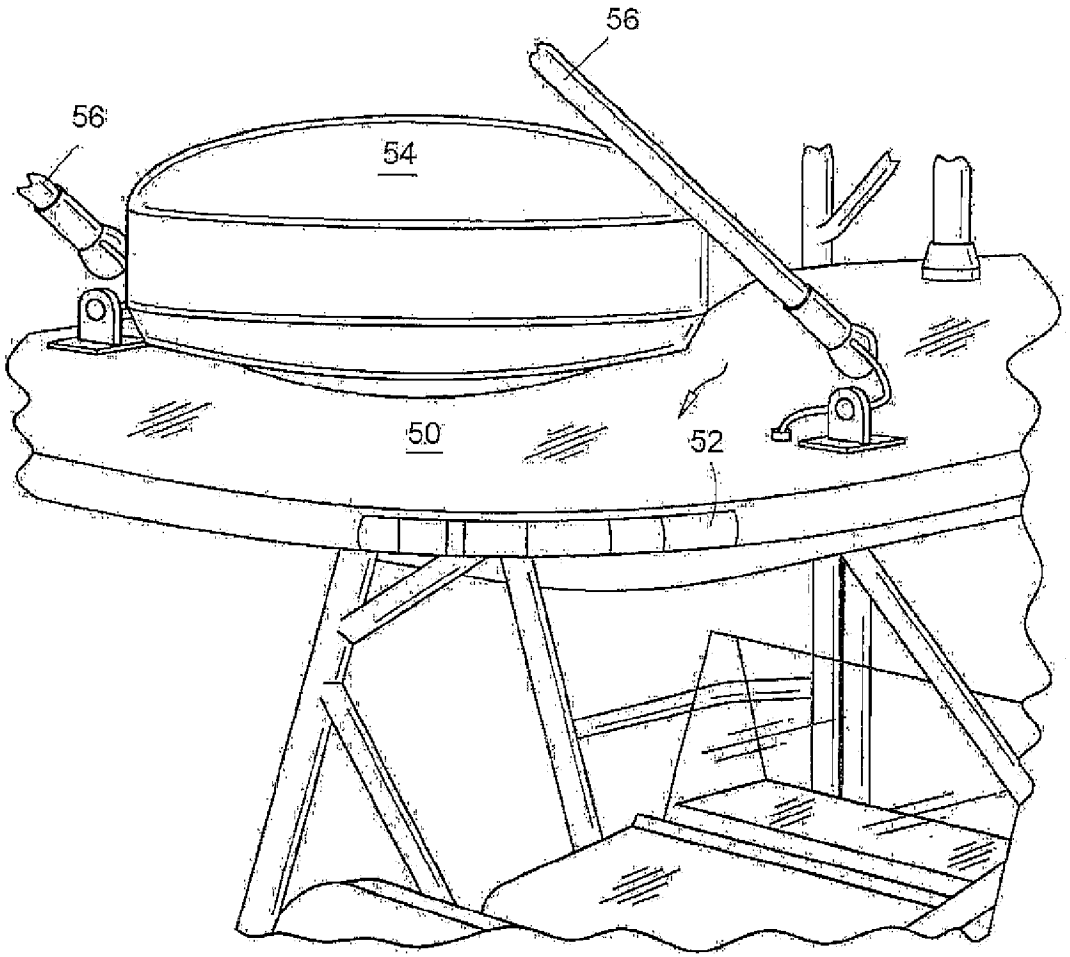
FIG. 6 shows a perspective view of a section of the boat hardtop, with a recessed light fixture within the hardtop, a radar unit, and antennas.

FIG. 6 illustrates a perspective view of a section of the boat hardtop 50 of the instant invention, with a recessed light fixture 52 within the hardtop, a radar unit 54, and antennas 56 mounted on hardtop 50.

Figure 7A:
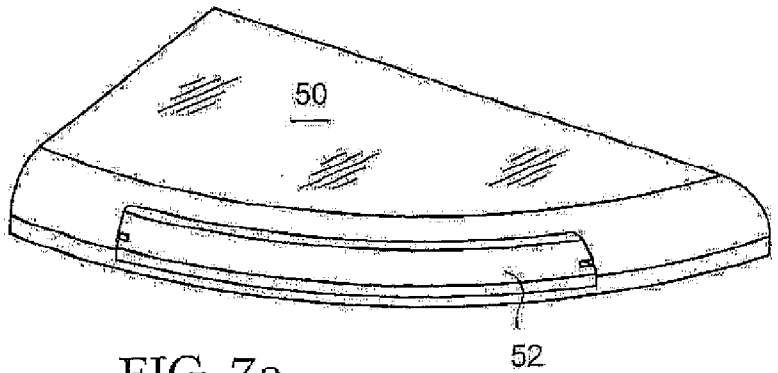
FIG. 7*a* shows an enlarged section of the recessed light fixture and hardtop of FIG. 6.

FIG. 7*a* shows an enlarged section of the recessed light fixture 52 installed within hardtop 50 of FIG. 6.

Figure 7B:
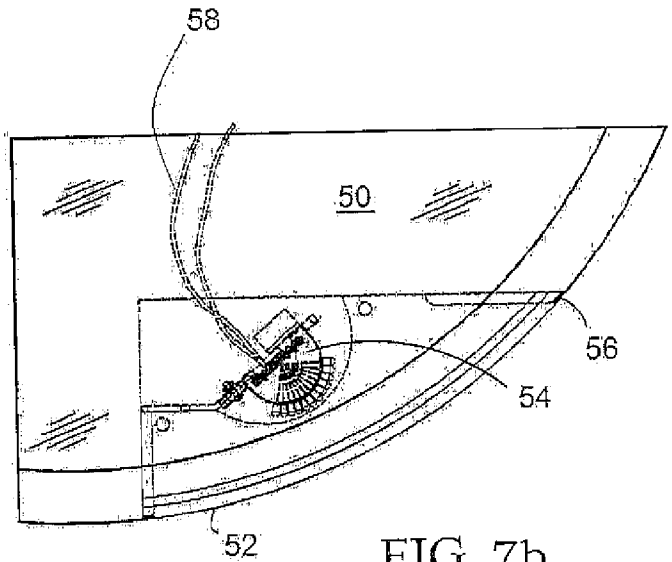
FIG. 7*b* shows a sectional top plan view of the light fixture installed within the hardtop.

FIG. 7*b* shows a sectional top plan view of the light fixture 52 installed within the hardtop 50. The light fixture includes an electronic module and LEDs 54 as well as lens 56. Electrical wires and conductive lines 58 are shown within the hardtop 50.

Figure 7C:
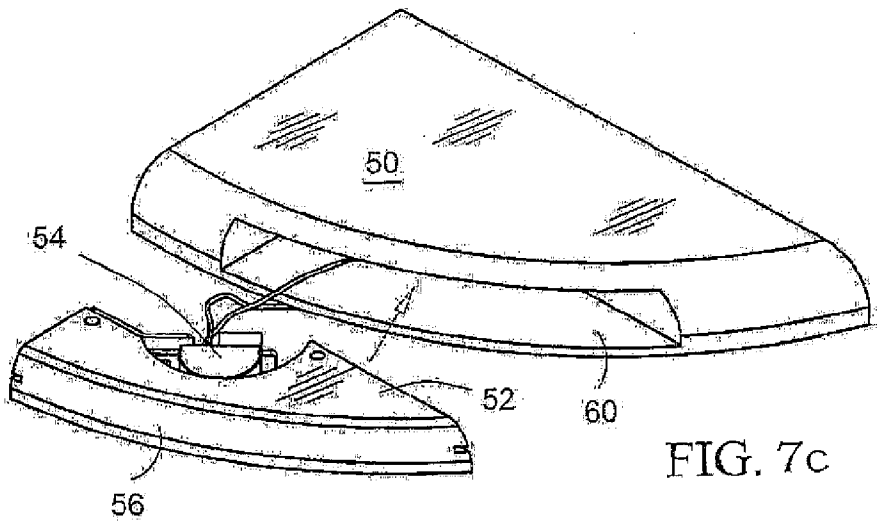
FIG. 7*c* shows an enlarged section of the recessed light fixture and hardtop of FIG. 6, as the light fixture is inserted within the hardtop recess.

FIG. 7*c* shows an enlarged section of the recessed light fixture 52 and hardtop 50 of FIG. 6, as the light fixture 52 is inserted within the hardtop recess 60. The electronic module 54 and lens 56 are also illustrated.

Figure 8:
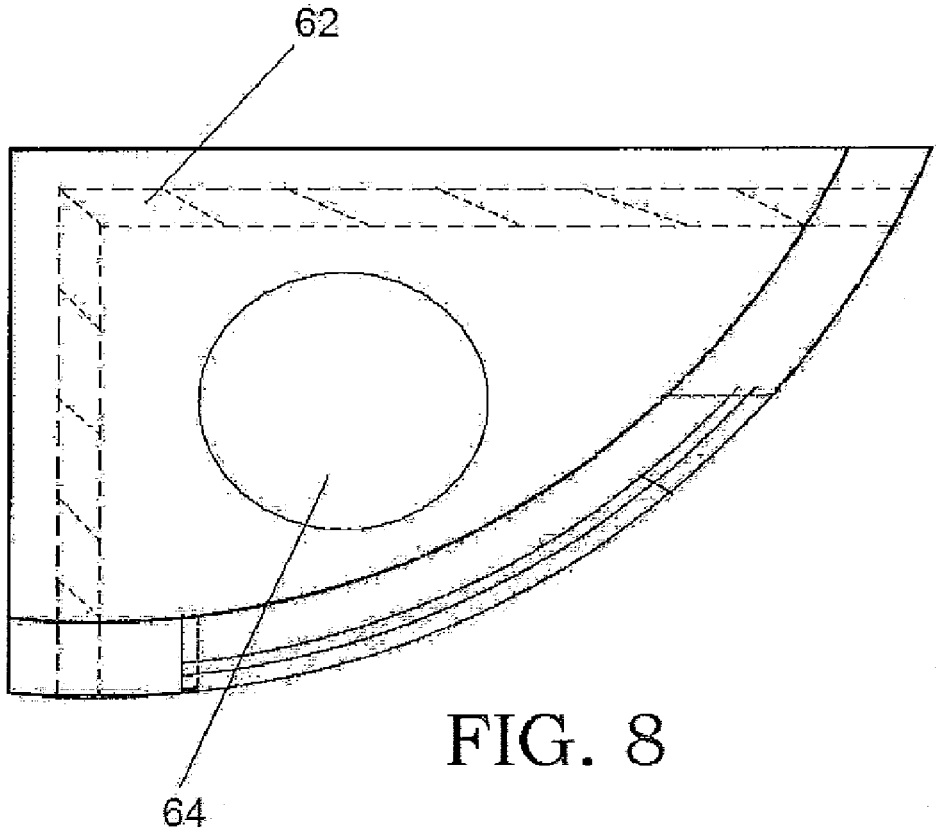
FIG. 8 shows a reinforcing plate installed within a section of the boat hardtop and the area of the hardtop which receives a leg flange.

FIG. 8 shows a reinforcing plate 62 installed within a section of the boat hardtop and the mounting area 64 of the hardtop which receives a leg flange as discussed above. The reinforcing plates can be of any thickness required as known to one of ordinary skill in the art, and is integrally formed within the fiberglass top during the manufacturing process utilizing known techniques for molds, laminates, fiberglass formation, pouring composites and thermoplastics, shaping and the like. The plates can be made from materials such as steel, structural aluminum or composites as a matter of design choice.

Figure 9:
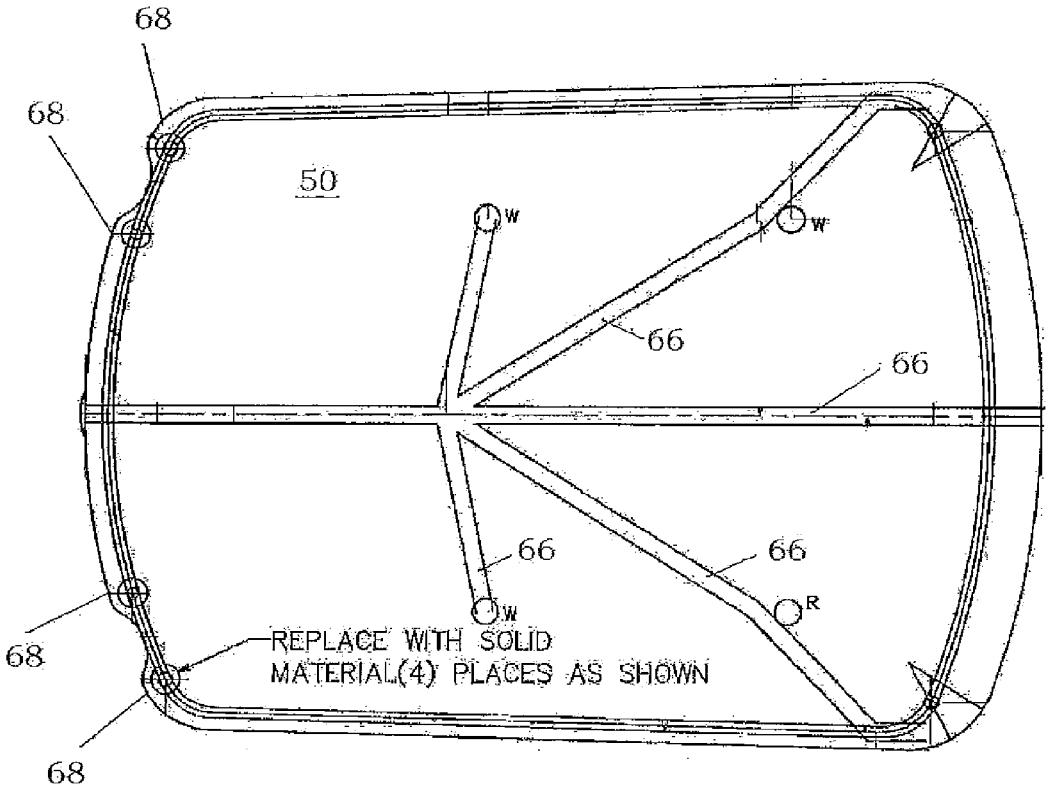
FIG. 9 shows top plan view of the hardtop with internal channels for receiving and housing.

FIG. 9 shows top plan view of the hardtop 501 with internal channels 66 for receiving and housing internal electrical wiring, cabling for steering systems, communication lines, coaxial cables and the like. Also shown are integral reinforcing circular plates 68 which are coaxially aligned to support the leg members of conversion tower units.

FIG. 10 Illustrates

Figures 10A, 10B, 10C, 10D, 10E:
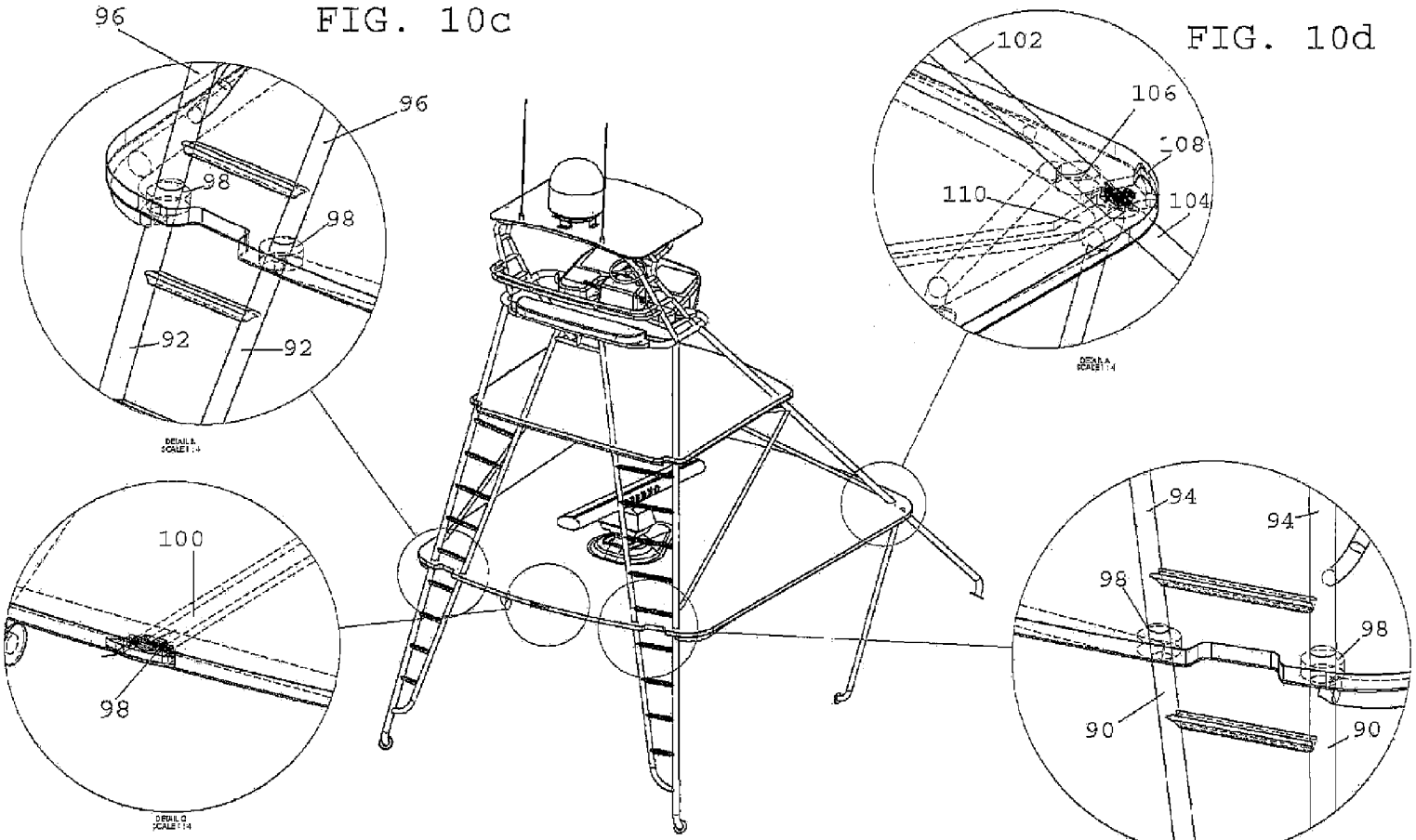
FIG. 10*a* shows a rear perspective view of the completed conversion tower.
FIG. 10*b* shows an enlarged perspective view of the right rear ladders and platform section of the completed conversion tower.
FIG. 10*c* shows an enlarged perspective view of the left rear ladders and platform section of the completed conversion tower.
FIG. 10*d* shows an enlarged perspective view of the right front leg member and platform section of the completed conversion tower.
FIG. 10*e* shows an enlarged perspective view of the central rear light and platform section of the completed conversion tower.

With respect to FIG. 10*a*, this view illustrates a rear perspective view of a complete conversion tower incorporating the instant invention. FIGS. 10*b* and 10*c*, depict the enlarged perspective view of the left and right rear ladders and platform sections, and the mounting assembly there between. Lower ladder leg members 90 and 92 are coaxially aligned and structurally secured to upper leg members 94 and 96. Reinforcing plates 98 are integral components of the hard top-platform assembly, and provide the structural reinforcement and support for the upper ladders, upper legs and upper tower assembly.

FIG. 10*d* illustrates an enlarged perspective view of the front right leg member and the front right platform section of the completed tower assembly. Upper leg member 102 and lower leg member 104 meet in coaxial alignment with structural reinforcing plate 106 interposed therein. Also shown is an addition light fixture 108 and internal channel 110.

FIG. 10*e* shows light fixture 98 mounted within the central core of the platform and into the receiving channel 100.

Figures 11A, 11B, 11C, 11D, 11E, 11F:
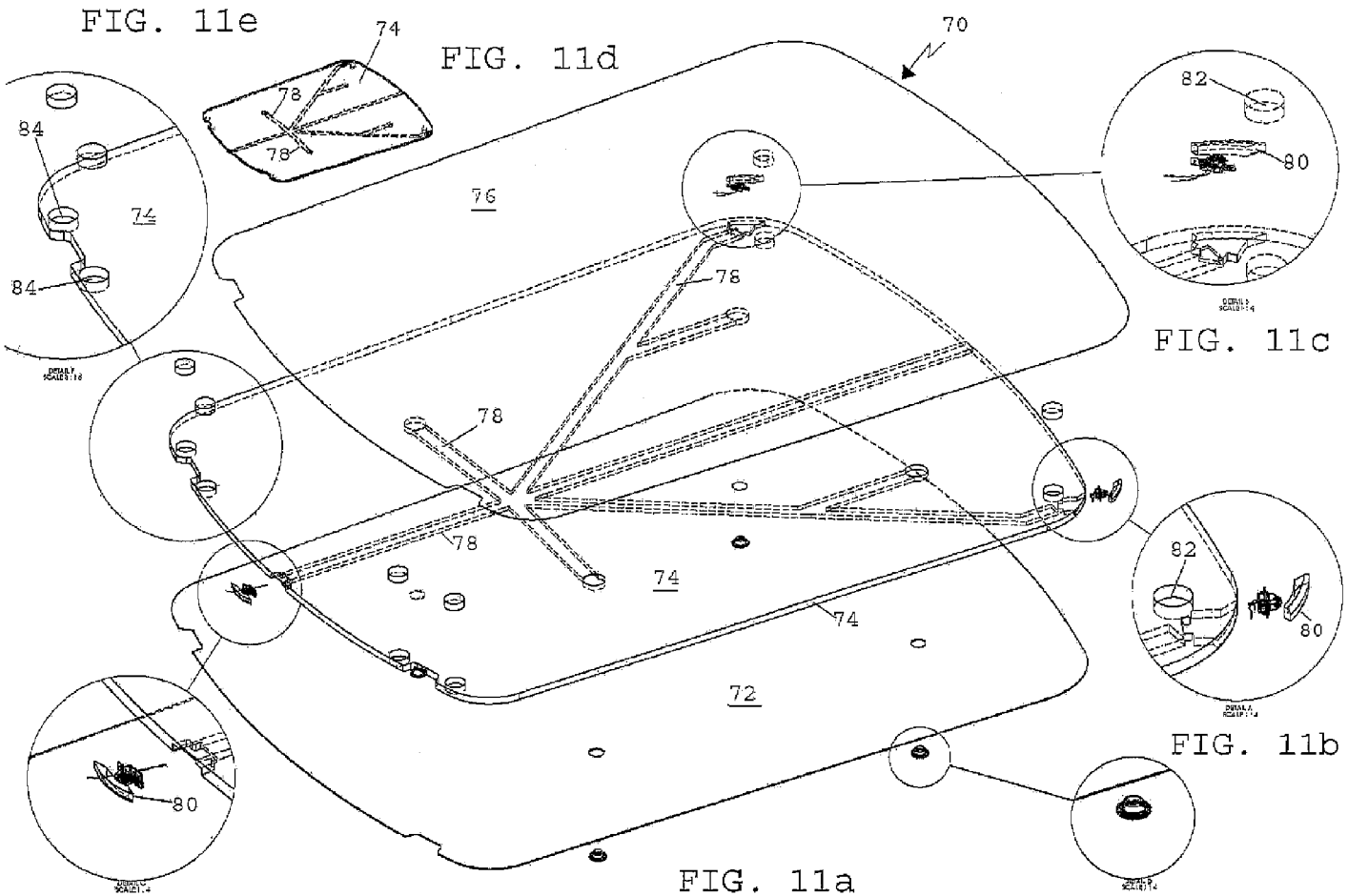
FIG. 11*a* shows an exploded perspective view of a platform of the instant invention.
FIG. 11*b* shows an enlarged perspective view of the right front light and reinforcement section of the central platform core of the instant invention.
FIG. 11*c* shows and enlarged perspective view of the left front light and reinforcement section of the central platform core of instant invention.
FIG. 11*d* shows a perspective view of the central core of the platform of the instant invention.
FIG. 11*e* shows an enlarged perspective view of the left rear ladder and reinforcement section of the central platform core of the instant invention.
FIG. 11*f* shows an enlarged perspective view of the rear center light section of the central core platform of the instant invention.

In reference to FIG. 11*a*, the hard top 70 is generally depicted in an exploded perspective view. Hard top 70 is generally comprised of a three part platform in this embodiment, constituting the underside fiberglass surface or skin 72, the central core 74, and the upper most top surface or skin 76. These surfaces can be fiberglass or alternatively other composites or materials in specific embodiments.

The central core 74 of the platform/hard top includes internal channels 78 which, as referenced above, are utilized for the running of conduits, electrical wiring, hydraulic lines and the like.

FIG. 11*b* illustrates an enlarged perspective view of the front right section of the internal and central core of the platform. An electrical lighting fixture 80 is depicted for insertion into the central core 74, in a manner as described with respect to FIG. 7*a* through 7*c* above. Also shown is reinforcing plate 82, which can be selected from metal plates, pads, flanges, or internal braces as discussed above. Reinforcing plates or pads 82, depicted in both FIGS. 11*b* and 11*c*, provide the structurally supporting interface between the front leg members of the lower tower units and upper tower units which are mounted to the hard top and platform assemblies.

FIG. 11*d* illustrates a perspective view of the central core 74 of the platform, which comprises the center of the hard top. Also shown are the internal channels 78 to accommodate various electrical and/or mechanical equipment.

FIG. 11*e* illustrates an enlarged perspective view of the left rear ladder and reinforcement section of the central platform core for the conversion tower. Reinforcing plates 84 accommodate the ladder pads, flanged ends, or mounting plates located at the ends of the ladder legs, as illustrated in FIGS. 1*a* and 1*b*. The reinforcing plates again provide the structural interface and support within the hard top 70, and allow the lower ladder sections and the upper ladder sections to be structurally secured to one another in a correct and predetermined coaxial alignment.

FIG. 11*f* illustrates the lighting fixture 80 for insertion into the rear center light section of the central core platform, and into the receiving channel.

Figure 12:
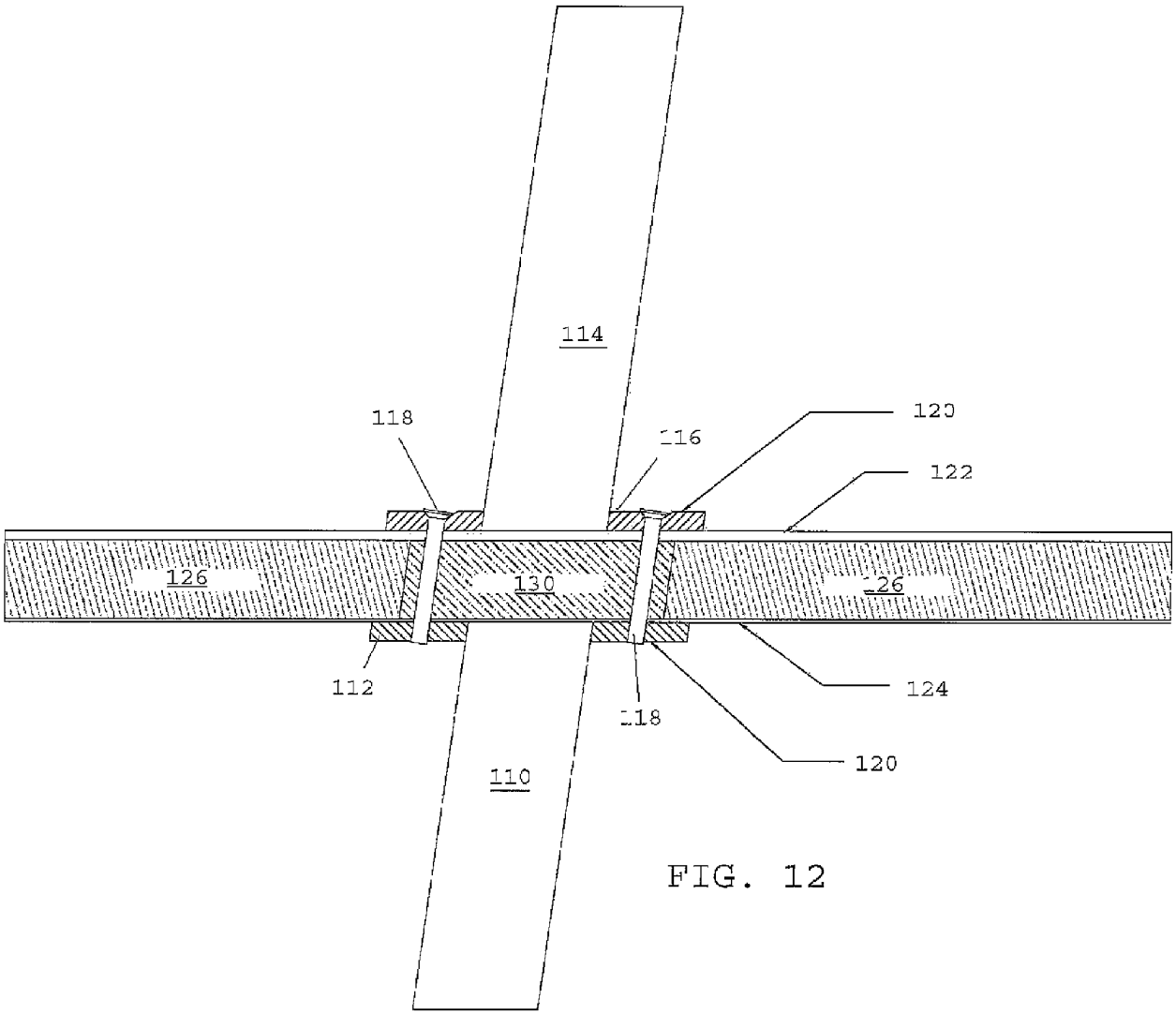
FIG. 12 shows a cross-sectional view of a reinforced platform section mating a lower tower leg member to an upper tower leg member in accordance with the instant invention.

FIG. 12 illustrates a cross sectional view of the mounting and manufacturing assembly which secure the leg members of the lower tower sections to the leg members of the upper tower sections. This includes the ladder legs as well as the separate legs. Lower tower tube or pipe 110 includes mounting flange or base 112. Upper tower tube or pipe 114 includes mounting flange or base 116. The mounting flange or base of upper leg member 114 and lower leg member 110 are secured to one another utilizing hardware 118. As will be apparent to one of ordinary skill in the art, alternative mounting hardware can be incorporated into the instant invention, such as threaded bolts, nuts, welded rods or any other equivalent structure. The terminating ends of upper tower leg member 114 and lower tower leg member 110 can include appropriate mounting pads or shaped flanges 120. The mounting pads or bases can be secured to the respective leg members utilizing appropriate welds, bonds, or alternatively can be manufactured as integral components and terminating in flanged ends of the leg members. This would be accomplished through appropriate designs for tooling and molds used in manufacturing the tubular leg members.

The hard top is depicted, which includes the top fiberglass surface or skin 122, the bottom fiberglass surface or skin 124, and the central core platform 126 of the instant invention. In a particular embodiment, the core platform is manufactured from an appropriate foam composition as well known in the manufacturing industry. Alternative foams are available of different densities and chemical compositions, including appropriate structural foams where desired. The central core could also be solid fiberglass if desired, or certain sections thereof.

Also indicated is an example of a reinforcing mounting plate 130, which provides the structural support and interface between the lower leg member 110 and upper leg member 114. The reinforcing plate 130 would be manufactured from an appropriate structural material, including various metal compositions, steel, alloys and the like. The platform's integral reinforcing member 130 is positioned between the mounting pads, flange or base 120 of the upper and lower leg members, all coaxially aligned with one another, and generally centered with respect thereto.

In alternative embodiments, reinforcing members 130 can be of any particular geometric shape, the important element being to provide the structural support and/or internal brace to provide a secure foundation between the leg members of the lower tower unit and the upper tower unit, whether the leg members are individual members, or paired leg members of any desired ladder.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A method for converting a boat tower from a half tower to a full tower comprising the following steps:

providing a bottom half tower structure and an upper tower structure each structure comprising:

platform for covering an area of the boat;

one or more ladders for supporting said platform, said ladders having one or more mounts at their base;

one or more legs for further supporting said platform;

at least said platform of said bottom half tower structure further having one or more integral reinforcement plates for receiving and supporting said upper tower structure;

at least said platform of said bottom half tower structure further having one or more passages for boat occupants to reach said platform, said passages including cut-out sections; wherein said passages are positioned adjacent to said ladders;

setting said upper tower structure on top of the bottom tower structure;

aligning said mounts of said ladders of the upper tower structure with the ladders of said bottom half tower structure over said cut-out sections in said platform of the bottom tower structure;

aligning said legs of the upper tower structure with the legs of said bottom half tower structure; and securing said mounts of said ladders of the upper tower structure to the ladders of said bottom half tower structure and securing said legs of the upper tower structure to the legs of said bottom half tower structure.

2. A full tower conversion for a boat, comprising a convertible half tower comprising a first platform, at least one first ladder for supporting said first platform, and at least one first leg for supporting said first platform; wherein said half tower is adapted to receive and support one or more additional tower sections without the need for removal of the half tower from the boat or destruction thereof;

wherein at least one of said additional tower sections comprises a second platform covering said first platform, at least one second ladder for supporting said second platform, and at least one second leg for supporting said second platform;

said at least one second ladder mating to and being generally coaxially aligned with said at least one first ladder and mounted between said first and second platforms;

said at least one second leg mating to and being generally coaxially aligned with said at least one first leg and mounted between said first and second platforms; and said first platform further having one or more integral reinforcement plates for receiving and supporting said second tower section.

3. The fall tower conversion of claim 2, wherein said platform comprises an upper skin, a lower skin and an internal core;

said integral reinforcement plates are secured within said internal core of said platform, wherein a first integral reinforcement plate is interposed between said first and second ladders and a second integral reinforcement plate is interposed between said first and second legs;

said first integral reinforcement plate and said first and second ladders are structurally secured to one another, and are generally coaxially aligned; and said second integral reinforcement plate and said first and second legs are structurally secured to one another, and are generally coaxially aligned.

4. The full tower conversion of claim 3 wherein said first platform further comprises one or more passages for boat occupants to reach said platform, wherein said one or more passages are positioned adjacent to said first and second ladders.

5. The full tower conversion of claim 3, comprising two of said first ladders, two of said second ladders, two of said first legs, and two of said second legs.

* * * * *